United States Patent [19]

Takada

[11] Patent Number: 4,603,713

[45] Date of Patent: Aug. 5, 1986

[54] LIFTING DEVICE FOR A HEDDLE FRAME

[75] Inventor: Hiroshi Takada, Kyoto, Japan

[73] Assignee: Murata Kikai Kabushiki Kaisha, Japan

[21] Appl. No.: 583,128

[22] Filed: Feb. 24, 1984

[30] Foreign Application Priority Data

Feb. 28, 1983 [JP] Japan ..... 58-33479

[51] Int. Cl.[4] ..... D03C 13/00

[52] U.S. Cl. ..... 139/82; 139/84

[58] Field of Search ..... 139/55.1, 82, 84, 88, 139/83, 57, 66 R

[56] References Cited

U.S. PATENT DOCUMENTS

| | | | |
|---|---|---|---|
| 1,610,021 | 12/1926 | McKenna | 139/55.1 |
| 1,845,715 | 2/1932 | Keys | 139/55.1 |
| 3,168,116 | 2/1965 | Krenz | 139/84 |
| 3,557,842 | 1/1971 | Porter | 139/55.1 |

FOREIGN PATENT DOCUMENTS

| | | | |
|---|---|---|---|
| 66655 | 12/1982 | European Pat. Off. | 139/82 |
| 362674 | 9/1938 | Italy | 139/66 R |
| 8202217 | 7/1982 | World Int. Prop. O. | 139/84 |

*Primary Examiner*—Henry S. Jaudon

*Attorney, Agent, or Firm*—Spensley Horn Jubas & Lubitz

[57] ABSTRACT

Disclosed is a lifting device for a heddle frame comprising a first motion transmission member for increasing an amount of displacement of an operating member put out from a shedding motion and a second motion transmission member for further increasing the amount of displacement of the first motion transmission member, which members are provided in a motion transmission route between the shedding motion and a heddle frame, the first and second motion transmission members being connected by a connection member, and the heddle frame being mounted on the second motion transmission member.

6 Claims, 3 Drawing Figures

LIFTING DEVICE FOR A HEDDLE FRAME

BACKGROUND OF THE INVENTION

1. Field of the Invention:

The present invention relates to a lifting device for a heddle frame in a weaving machine.

2. Prior Art:

In the weaving machine wherein a heddle frame carrying a number of heddles thereon is moved up and down to shed a warp, a dobby or a cam box is used as a shedding motion of the heddle frame, wherein the shedding motion is positioned above the frame of the weaving machine, the heddle frame is hung by means of a lifting lever, and the lifting lever is connected to the shedding motion by means of a wire cable to lift the heddle frame. However, if the shedding motion is positioned above the frame, the cable, the shedding motion and the like are in the way when the heddle frame is replaced and therefore the replacing work becomes cumbersome. Lubricating oil of the shedding motion falls on the woven fabrics to contaminate the fabrics. In addition, in the textile factories where a number of looms are arranged, the shedding motion located above the frame deteriorates a view above the heddle frame. Prior art devices involve various problems as noted above.

In view of the aforementioned problem, there has been a proposal in which the shedding motion is arranged below the weaving machine.

In this case, the shedding motion is arranged at the lower side of the weaving machine, and therefore, the weaving machine increases in lateral width as a whole. In factories where dozens of looms are disposed, a floor area occupied thereby becomes larger and the number of units operated by one operator decreases to lower the working efficiency.

SUMMARY OF THE INVENTION

It is an object of the present invention to provide a lifting device for a heddle frame which allows a shedding motion to be formed a smaller size.

More specifically, the present invention provides an apparatus wherein an amount of displacement of an operating member put out by the shedding motion is enlarged at least in two stages to transmit it to a heddle frame, the shedding motion is formed into a smaller size and an amount of lifting of the heddle frame can be set to a predetermined amount, that is, to an amount by which a shed enough for weft insertion can be formed.

In accordance with the present invention, there are provided a first motion transmission member for increasing an amount of displacement of an operating member put out from a shedding motion and a second motion transmission member for further increasing the amount of displacement of the first motion transmission member, in a motion transmission route between the shedding motion and a heddle frame, and the first and second motion transmission members are connected by a connection member. Therefore, the amount of displacement put out from the shedding motion can be diminished and accordingly, the shedding motion can be formed into a smaller size. Particularly, where the shedding motion is arranged below the weaving machine, that is, below the heddle frame, an area occupied by the shedding motion can be reduced, and in factories where a number of looms are juxtaposed laterally, the number of units operated by one operator is not decreased and the moving distance for work can be reduced. The present invention has various advantages as noted above.

DETAILED DESCRIPTION OF THE INVENTION

An embodiment of the present invention will be described hereinafter with reference to the drawings.

Figure 1:
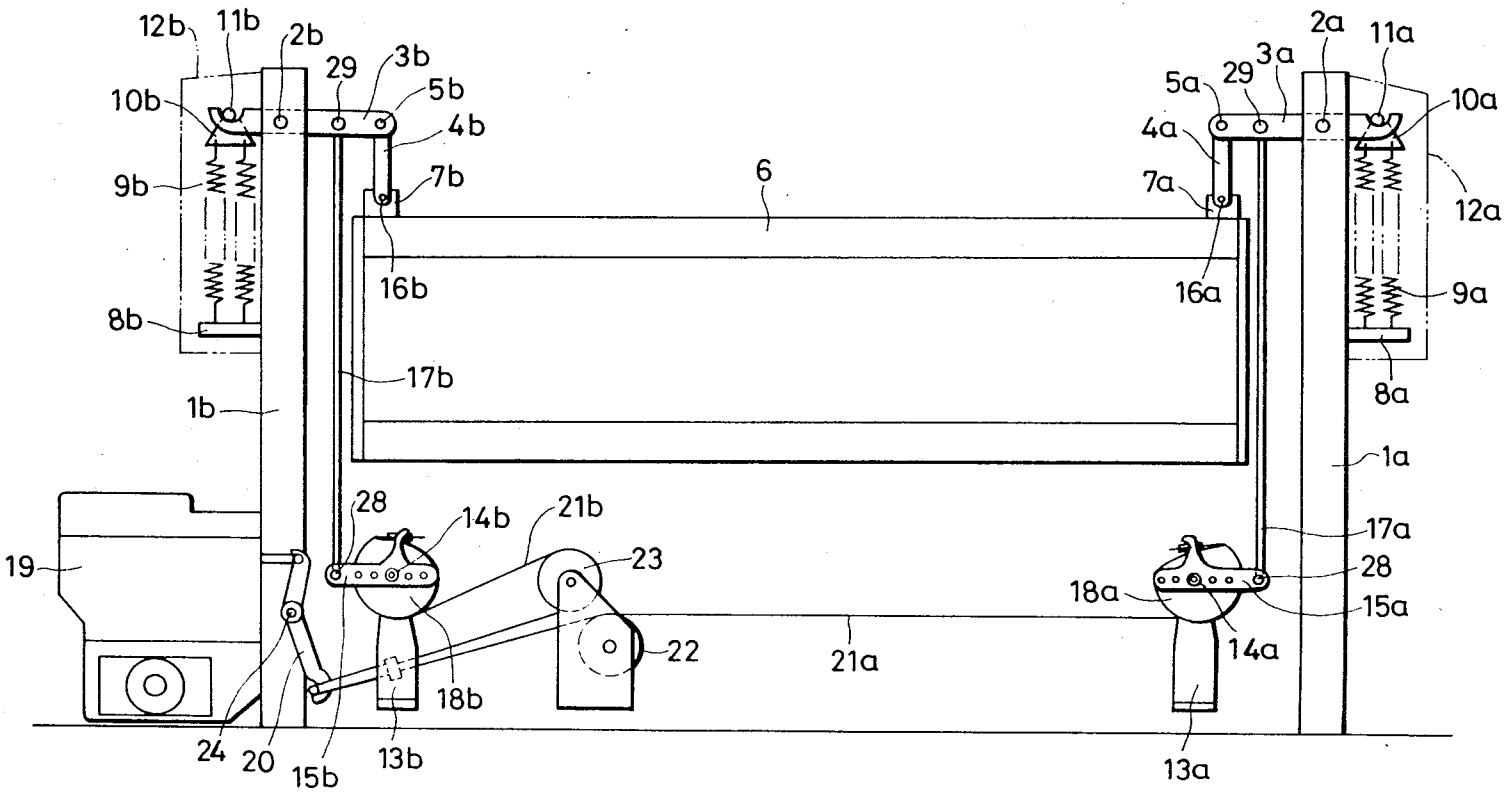
FIG. 1 is a schematic front view showing an embodiment of the present invention.

Referring to FIG. 1, connectors 4*a*, 4*b* are pivotally supported at 5*a*, 5*b* on one end of a pair of carrier levers 3*a*, 3*b* as the second motion transmission members which are pivotable about pivots 2*a*, 2*b* relative to frames 1*a*, 1*b* of a weaving machine, and lower ends of the connectors 4*a*, 4*b* are pivotally supported at 16*a* 16*b* on brackets 7*a*, 7*b* of a heddle frame 6 whereby the heddle frame 6 is hung and supported.

The other ends of the carrier levers 3*a*, 3*b* are engaged by pins 11*a*, 11*b* of spring support plates 10*a*, 10*b* which lock the other ends of springs 9*a*, 9*b* locked to brackets 8*a*, 8*b* one end of which are secured to the frames 1*a*, 1*b* to always bias the carrier levers 3*a*, 3*b* in a direction wherein the heddle frame 6 moves up.

Reference numerals 12*a*, 12*b* designate covers for the springs 9*a*, 9*b*. By the provision of the springs 9*a*, 9*b* externally of the frames 1*a*, 1*b*, reinstalling work of the springs can be performed easily and adherence of fly wastes is prevented by the covers 12*a*, 12*b*, or in a weaving machine provided with a weft inserter by means of water-jet, adherence of scattered water can be also prevented, and in addition, rust can be prevented.

Pivotal levers 15*a*, 15*b* as the first motion transmission members, which are pivotable about first fixed pivots 14*a*, 14*b* supported on fixed brackets 13*a*, 13*b*, are pivotally supported at location below the heddle frame 6, and connecting rods 17*a*, 17*b* are pivotally supported between one end of the levers 15*a*, 15*b* and the carrier levers 3*a*, 3*b*.

Guide plates 18*a*, 18*b* whose peripheral surfaces have curves are integrally fastened to the pivotal levers 15*a*, 15*b*. It will be noted that the guide plates 18*a*, 18*b* and pivotal levers 15*a*, 15*b* can be subjected to die casting so as to form a one-piece arrangement.

Wire cables 21*a*, 21*b*, which are moved by a jack lever 20 of a shedding motion 19, are secured to the pivotal levers 15*a*, 15*b* while being wound about the guide plates 18*a*, 18*b*.

Reference numerals 22, 23 designate guide rollers for the wire cables 21*a*, 21*b*.

The shedding motion 19 provided at the lower side of the frame 1*b* comprises devices such as a dobby, a cam box, etc. The jack lever 20 corresponding to each of the heddle frames is turned clockwise through a predetermined angle about the pivot 24 by means of the shedding motion 19 whereby the wire cables 21*a*, 21*b* are drawn to actuate the pivotal levers 15*a*, 15*b*, and the carrier levers 3*a*, 3*b* are turned about the pivots 2*a*, 2*b* through rods 17*a*, 17*b* to move down the heddle frame 6.

The heddle frame 6 can be moved upwards by the forces of the springs 9*a*, 9*b*.

Figure 2:
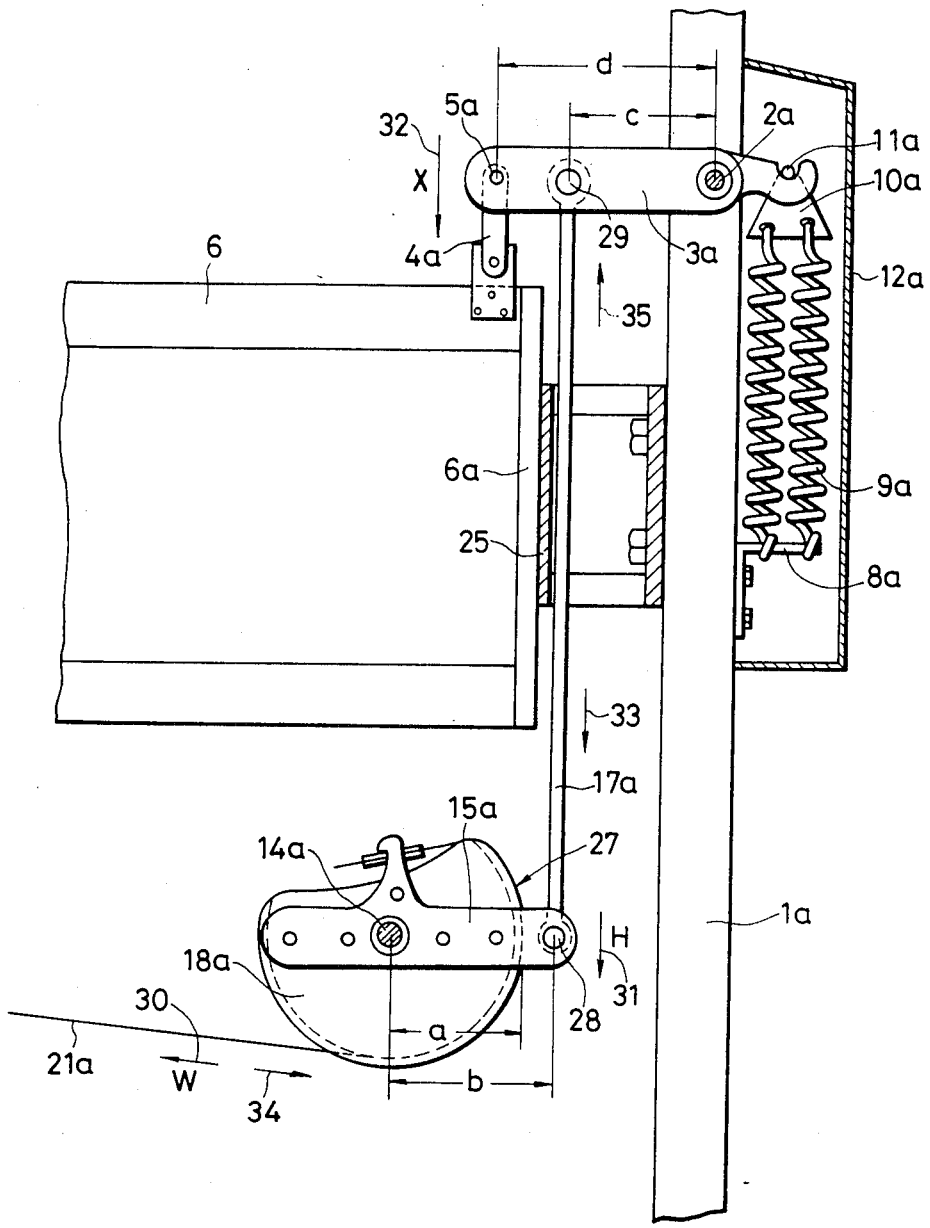
FIG. 2 is a front view partly in section showing the structure of essential portions.
Figure 3:
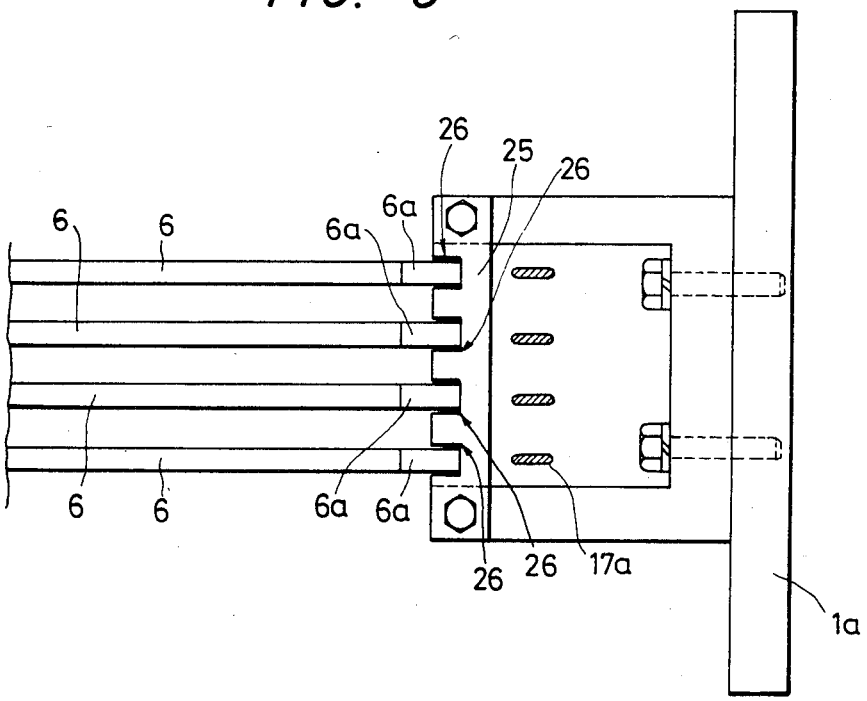
FIG. 3 is a plan view partly in section of the same.

In FIGS. 2 and 3, a guide 25 is secured to the frame 1*a*, and a longitudinal frame 6*a* of the heddle frame 6 is slidably moved within a guide groove 26 to prevent lateral movement of the heddle frame 6.

It will be noted of course that the guide 25 is also provided on the side of the frame 1*b* in FIG. 1.

Only one of the rods 17*a*, 17*b* for connecting the pivotal levers 15*a*, 15*b* with the carrier levers 3*a*, 3*b* is shown. However, if it is designed so that two rods are connected at their intermediate portions, and for example, a turnbuckle or the like is provided or one rod end is cylindrical and the other rod end is inserted into said cylindrical interior and threadedly fixed, the length of the rods 17*a*, 17*b* can be adjusted and where the heddle frames of different height are used, the length of the rods 17*a*, 17*b* can be merely adjusted to change the mounting position of the pivots 2*a*, 2*b* of the carrier levers 3*a*, 3*b* and a new connecting rod need not be provided.

Also, in FIG. 2, the mounting position of the connecting rod 17*a* at the side of the pivotal lever 15*a* is such that if let a represent the distance or radius between the pivotal center 14*a* of the pivotal lever 15*a* and the peripheral surface 27 of the guide plate 18*a* and b represent the distance between the connection portion 28 of the rod 17*a* and the center 14*a*, the mounting position will be at least $a<b$, and the mounting position thereof at the side of the carrier lever 3*a* is such that if let c represent the distance between the pivot 2*a* of the lever 3*a* and the connection portion 29 of the rod 17*a* and d represent the distance between the pivotal lever connection portion 5*a* of the connector 4*a* and the pivot 2*a*, the mounting position will be the position which is satisfied with at least relation of $c<d$.

In the lifting device for the heddle frame as described above, assuming that the wire cable 21*a* is drawn by the shedding motion 19 through the distance W in a direction as indicated by the arrow 30 of FIG. 2, the guide plate 18*a* and pivotal lever 15*a* are turned together clockwise about the fixed pivot 14*a*, and the connection portion 28 of the connecting rod 17*a* is moved down through the distance H in a direction as indicated by the arrow 31.

Actually, the connection portion 28 takes circular motion but moves downwardly linearly since the distance b is great.

By the movement of the connectinng rod 17*a*, the connection portion 5*a* of the carrier lever 3*a* with the connector 4*a* is also moved through the distance X downwardly, that is, in the direction of the arrow 32.

The aforesaid distance X is also substantially linearly downwardly moved similar to the movement of the pivotal lever 15*a* at rod connection portion 28.

In this case, the moving distance W of the wire cable is enlarged in two stages by the following formulae to assume the distance X of downward movement of the heddle frame.

$$H=b/a\times W$$

$$X=d/c\times H$$

Accordingly, $X\approx b/a\times d/c\times W$ is obtained.

For example, if the relation of $b/a=1.2$ and $d/c=1.2$ is present, $X\approx 1.4W$, and if the length of downward movement of the heddle frame is 70 cm, the moving distance of the wire cable will be approx. 50 cm. The amount of displacement or a turning angle of the operating member or jack lever 20 at the side of the shedding motion to which is connected the wire cable can be made small. At this time, a load applied to the connecting rod 17*a* is the tension in the direction of arrow 33 and no compressive force is applied thereto. When the heddle frame is moved down, the tension can be reduced by the own weight of the heddle frame.

On the other hand, when the heddle frame is returned, the carrier lever 3*a* is turned clockwise about the fixed pivot 2*a* by the spring 9*a*, the wire cable is drawn in the direction of arrow 34 of FIG. 2 through the connecting rod 17*a*, and the heddle frame is returned to its original position by means of a stopper mechanism within the shedding motion 19.

It will be noted that even in this case, the tension in the direction of arrow 35 is merely applied to the connecting rod 17*a* but no compressive force is applied thereto. Thus, the rod, which generally cannot withstand the compressive force can be made smaller in diameter to enable to be light-weighted.

It will be further noted that in view of the fact that only the tension exerts on the connecting rod, the pivotal lever 15*a* and the carrier lever 3*a* can be connected by a cable in place of the rod.

As described above, in this present invention, the heddle frame 6 is hung through the connectors 4*a*, 4*b* on one end of the carrier levers 3*a*, 3*b* pivotably supported on the fixed pivots 2*a*, 2*b*, and the springs 9*a*, 9*b* are connected between the lever end opposite the pivot of said lever and the fixed frame whereas being connected by the connection members 17*a*, 17*b* between the pivotal levers 15*a*, 15*b* pivotable about the fixed pivots 14*a*, 14*b* separately from the first mentioned pivots through the wire cables 21*a*, 21*b* operated by the shedding motion 19 and the carrier levers 3*a*, 3*b*. The connection portion 28 between the pivotal levers 15*a*, 15*b* and the connection members 17*a*, 17*b* are positioned externally of the acting point 27 at which the wire cable acts on the pivotal lever, and the connection portion 29 between the connection members 17*a*, 17*b* and the carrier levers 3*a*, 3*b* is positioned at the middle between the pivots 2*a*, 2*b* of the carrier levers and the connector connection portion 5*a*. That is, the shedding motion 19, the operating member 20 put out by the shedding motion 19 during the transmission of motion of the heddle frame 6 or the first motion transmission member for increasing the amount of displacement of the wire cable or the pivotal lever, and the second motion transmission member for increasing the amount of displacement of the first motion transmission member or the carrier lever are provided, and the first and second motion transmission members are connected by the connection member. Therefore, it is possible to reduce the amount of displacement put out from the shedding motion and accordingly, the shedding motion can be made in a smaller size.

What is claimed is:

1. A lifting device for a heddle frame characterized in that in a motion transmission route between a shedding motion and a heddle frame there are provided a first motion transmission member for increasing an amount of displacement of an operating member moved by the shedding motion and a second motion transmission member for further increasing the amount of displacement of said first motion transmission member, and further characterized in that said motion transmission members are connected to each other by a connection member and the heddle frame is mounted on the second motion transmission member;

a. wherein the first motion transmission member comprises a pivotal lever which is pivoted about a first fixed pivot and a guide plate having a curved peripheral surface mounted on the pivotal lever, and wherein the operating member comprises a cable which is wound on and secured to the peripheral surface of the guide plate;

b. wherein the second motion transmission member comprises a carrier lever pivotably supported on a fixed frame through a second fixed pivot and having first and second ends on opposite sides of the fixed frame, wherein the heddle frame is hung on the first end of the carrier lever through a connector means and, wherein a spring is stretched between the second end of the carrier lever and the fixed frame; and c. wherein the connection member for connecting the first and second motion transmission members comprises a connection rod, wherein the pivotal lever of the first motion transmission member is positioned below the carrier lever of the second transmission member, wherein the connection portion of the connecting rod to the pivotal lever is positioned away from the first fixed pivot of the pivotal lever from an acting point of the cable on the pivotal lever, and wherein the connection portion between the connecting rod and the carrier lever is positioned between the second pivot of the carrier lever and the connection portion between the connector means and the carrier lever.

2. A lifting device according to claim 1 wherein the cable is made of wire.

3. In a loom having a fixed frame, a heddle mechanism comprising:

a. a linearly movable heddle frame supported with respect to the fixed frame of the loom;

b. actuation means for controlling the shedding movement of the heddle frame, including an actuator element movable a preselected linear distance; and c. transmission means for coupling the actuator element of the actuator means to the heddle frame, and for moving the heddle frame a linear distance in response to linear movement of the actuator element, said transmission means including:

(i) a first transmission member coupled to the actuator element and rotatable in response to movement of the actuator element;

(ii) a connection member coupled at a first end to the first transmission member and linearly movable in response to rotation of the first transmission member, wherein the actuator element, first transmission member and connection member are configured to interact so that linear movement of the actuator element by the preselected distance results in a linear movement of the connection member which exceeds the preselected distance; and (iii) a second transmission member coupled to the connection member at a second end of the connection member and rotatable in response to movement of the connection member, the second transmission member also coupled to the heddle frame, wherein the connection member, second transmission member and heddle frame are configured to interact so that linear movement of the connection member results in a greater linear movement of the heddle frame; and d. wherein the first transmission member is below the heddle frame and comprises a supporting means and a first lever pivotably supported on said supporting means, and wherein the second transmission member comprises a second lever pivotably supported on a portion of the fixed frame above the heddle frame;

e. wherein the first transmission member further includes a substantially circular guide plate mounted on the first lever, wherein the actuator element includes (a) an actuator lever pivotably supported on a portion of the fixed frame below the heddle frame, wherein said actuator lever is pivotably movable through a predetermined angle relative to the fixed frame, and (b) a cable secured at a first end to the actuator lever and at a second end to the guide plate, and wherein pivotal movement of the actuator lever draws on the cable to thereby actuate pivotal movement of the first lever;

f. wherein the cable is made of wire;

g. wherein the heddle frame is linearly movable in an up/down direction between a first up position and a second down position, and further including a biasing means for biasing the second lever in a position which holds the heddle frame in said first up position; and h. wherein the second lever includes first and second portions on opposite sides of the fixed frame, wherein said first portion is on the same side of the fixed frame as the heddle frame, wherein the heddle frame is coupled to the end of said first portion of the second lever through a coupling means, and wherein the connection member is coupled at its second end to said first portion of the second lever at a location between the fixed frame and the end of said first portion of the second lever.

4. The heddel mechanism of claim 3 further including:

a bracket means extending from the fixed frame below and on the same side of the fixed frame as the second portion of the second lever; and spring means secured between said second portion of the second lever and said bracket means for biasing the second lever in a predetermined direction.

5. The heddle mechanism of claim 4 wherein the connection member is coupled to the first lever at a location between the fixed frame and the point on the first lever where the cable acts.

6. The heddle mechanism of claim 5 wherein the connection member is a rod.

* * * * *